US006543065B2

(12) United States Patent
Hsieh

(10) Patent No.: US 6,543,065 B2
(45) Date of Patent: Apr. 8, 2003

(54) TOILET BOWL COVER

(76) Inventor: Elvis Hsieh, No. 31, 24$^{th}$ Road, Taichung Industrial Park, Taichung (TW)

( * ) Notice: Subject to any disclaimer, the term of this patent is extended or adjusted under 35 U.S.C. 154(b) by 0 days.

(21) Appl. No.: 10/073,294

(22) Filed: Feb. 13, 2002

(65) Prior Publication Data

US 2003/0028955 A1 Feb. 13, 2003

Related U.S. Application Data

(63) Continuation-in-part of application No. 09/925,456, filed on Aug. 10, 2001.

(51) Int. Cl.$^{7}$ ..... A47K 13/00

(52) U.S. Cl. ..... 4/234; 4/242.1; 4/237; 428/292.4; 428/292.7

(58) Field of Search ..... 4/237, 234, 242.1; 428/74, 76, 113, 190, 191, 292.4, 292.7

(56) References Cited

U.S. PATENT DOCUMENTS 1,121,951 A * 12/1914 Thickens
1,356,847 A * 10/1920 Arosio
1,656,955 A * 1/1928 Schaal
1,829,526 A * 10/1931 Leslie
1,860,000 A * 5/1932 Van Arnam
1,863,799 A * 6/1932 Loetscher
2,124,921 A * 7/1938 Lederer
2,200,394 A * 5/1940 Leslie ..... 4/242.1
2,260,155 A * 10/1941 Schwartz
2,655,666 A * 10/1953 Schmidt ..... 4/242.1
2,899,689 A * 8/1959 Pastl
2,910,705 A * 11/1959 Coplan ..... 4/242.1
2,966,686 A * 1/1961 Beneke, Jr.
3,927,235 A * 12/1975 Chow
4,085,468 A * 4/1978 Seiderman
5,741,391 A * 4/1998 Ollila
2002/0139082 A1 * 10/2002 DeFord et al.

FOREIGN PATENT DOCUMENTS

WO WO 99/01296 * 1/1999

* cited by examiner

*Primary Examiner*—Charles R. Eloshway
(74) *Attorney, Agent, or Firm*—Rosenberg, Klein & Lee

(57) ABSTRACT

A toilet bowl cover including a main body made of wooden material. The main body is enclosed by a cover layer. The cover layer is made of fabric or paper material with natural fibers. The cover layer is further enclosed by an outer layer. The cover layer serves to fill up the irregular portions of the outer face of the main body. Also, the cover layer serves as a lining of the outer layer to highlight the colors of the outer layer.

8 Claims, 5 Drawing Sheets

TOILET BOWL COVER

CROSS-REFERENCE TO RELATED APPLICATION

This application is a Continuation-in-Part Application of Ser. No. 09/925,456, filed Aug. 10, 2001, and entitled "STOOL COVER," now abandoned.

BACKGROUND OF THE INVENTION

1. Field of the Invention

The present invention is related to an improved toilet bowl cover. The main body of the toilet bowl cover is enclosed by a cover layer that serves as a lining of the outer layer to smoothen the outer layer and highlight the colors of the outer layer.

2. Description of Related Art

A conventional toilet bowl cover is made of plastic material by injection molding or wooden material by milling. Consequently, the conventional toilet bowl cover has a cold appearance and monotonous facial color.

Another type conventional toilet bowl cover is made of powdered waste wooden chips. The powdered wooden chips are pressed into a blank of the toilet bowl cover. A paper sheet or a wooden sheet is overlaid on the outer face of the blank as a layer to embellish the toilet bowl cover. However, the conventional toilet bowl cover still lacks a warm appearance and live color. Moreover, the blank of the toilet bowl cover made of waste wooden chips has a rugged surface. The surface of the toilet bowl cover is still rough after being overlaid with a thin paper sheet. As a result, the user will feel uncomfortable when using the conventional toilet bowl.

Consequently, an improved conventional toilet bowl cover is marketed. The conventional toilet bowl cover has a fabric material overlaid thereon such that the toilet bowl cover has a better rigidity and is not easy to be cracked. However, it is found in tests that in the case that a thicker fabric material is overlaid on the toilet bowl cover blank, the cost will be higher. In the case that a thinner fabric material is overlaid on the blank, it is almost impossible to completely shade the original color of the wooden chips.

The conventional toilet bowl cover blank made of waste wooden chips can be painted. However, the conventional painting method of toilet bowl cover, the toilet bowl cover blank must be first buffed and a substrate paint is painted on the blank to shade the original color of the wooden chips. Then the surface of the blank is sanded and smoothed. Finally, the blank is painted with facial paint to achieve bright appearance. The above procedures are troublesome so that the manufacturing cost is increased.

SUMMARY OF THE INVENTION

It is therefore a primary object of the present invention to provide an improved toilet bowl cover. The toilet bowl cover in accordance with the present invention comprises a main body made of wooden material. The main body is first enclosed by a cover layer. The cover layer is further enclosed by an outer layer. The cover layer is provided to fill up the rough portions of the outer face of the main body and as a lining of the outer layer.

It is a further object of the present invention to provide the above toilet bowl cover in which the outer layer is made of paper material with natural fibers to lower manufacturing cost.

It is a further object of the present invention to provide the above toilet bowl cover in which the outer layer is facially painted. The cover layer enclosing the main body of the toilet bowl cover serves to substitute for the processing measures that include buffing, filling and painting substrate, etc. which saves working time and labor.

DETAILED DESCRIPTION OF THE PREFERRED EMBODIMENTS

Figure 1:
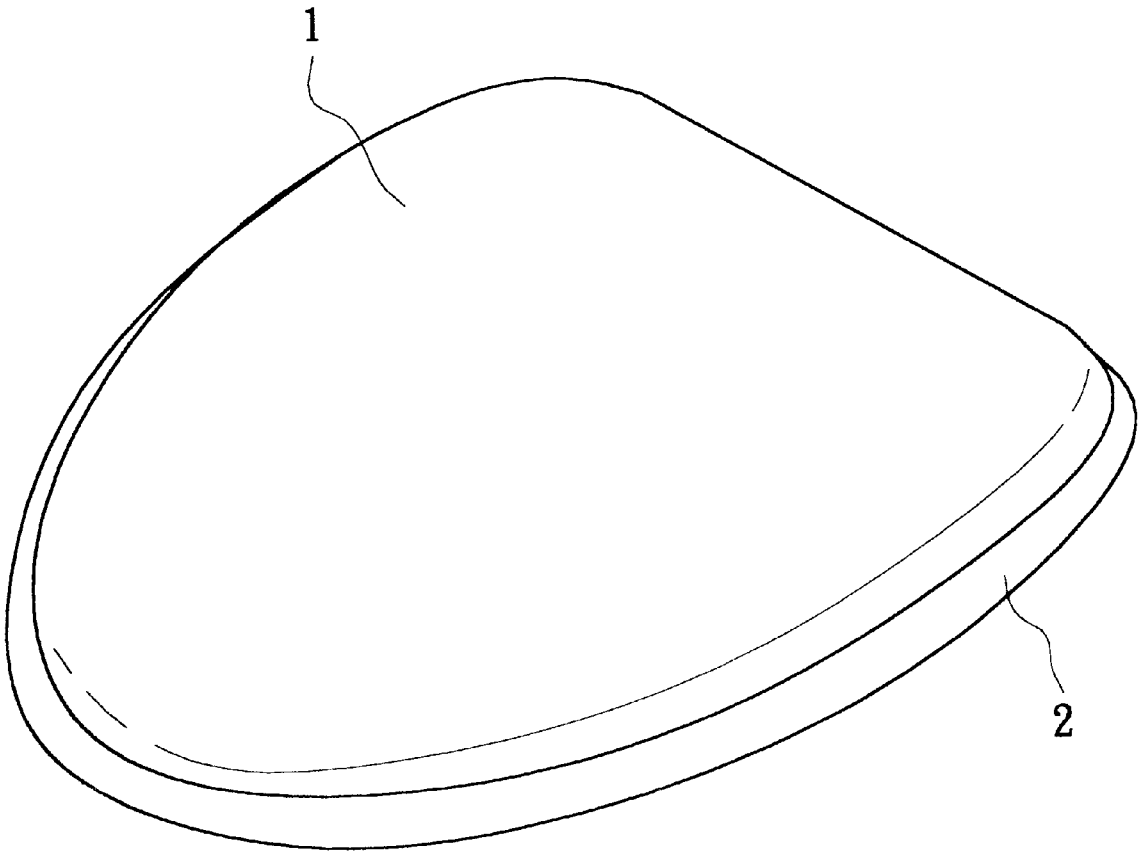
FIG. 1 is a perspective view of a toilet bowl cover in accordance with the present invention.
Figure 2:
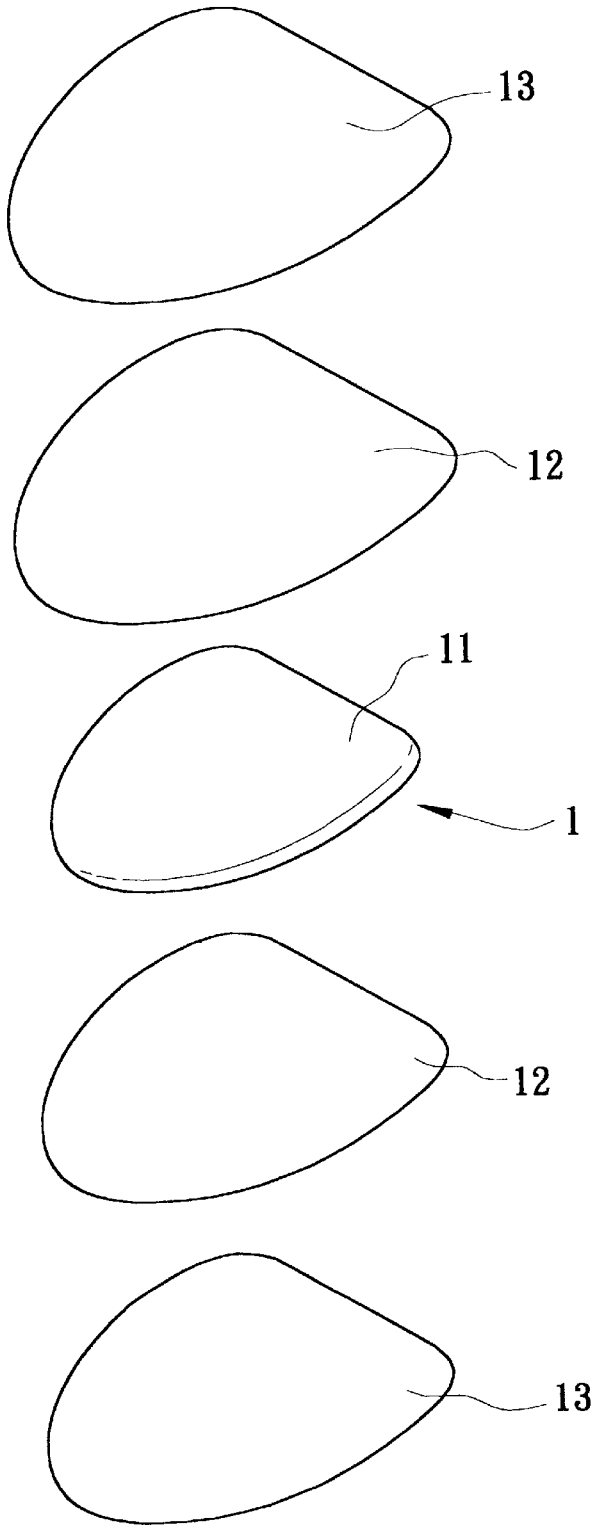
FIG. 2 is an exploded perspective view of the toilet bowl cover in FIG. 1.
Figure 3:
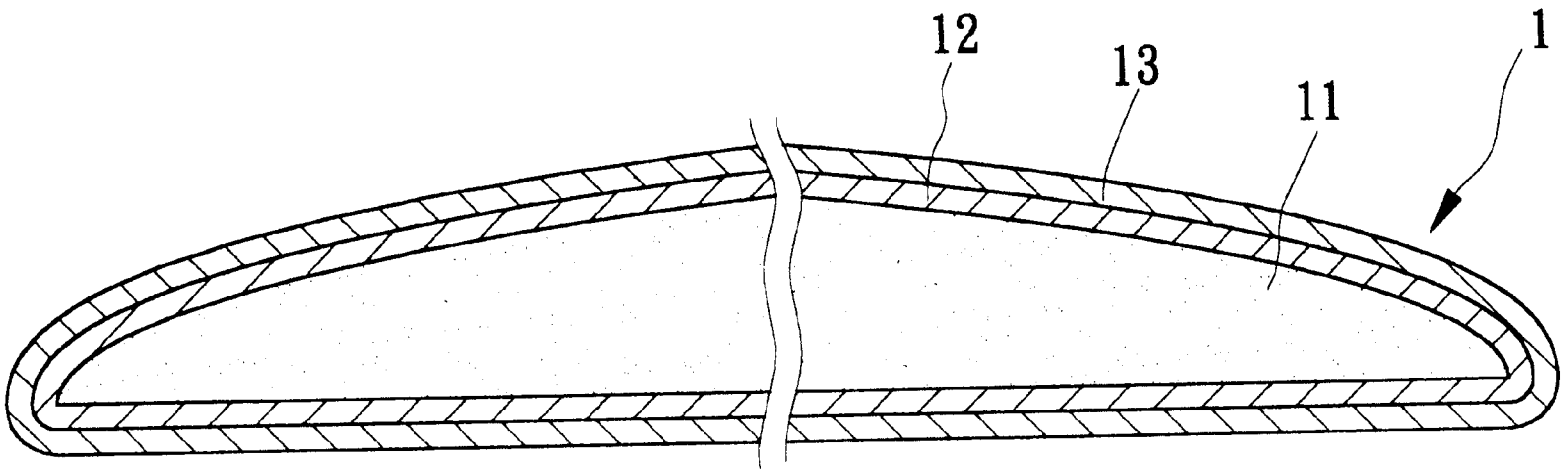
FIG. 3 is sectional plan view of the toilet bowl cover in FIG. 1.

With reference to FIGS. 1–3, the toilet bowl cover (1) in accordance with the present invention is adapted to be pivotally mounted to a toilet bowl seat (2). The toilet bowl cover (1) comprises a main body (11) made of waste wooden chips by being pressed. The main body (11) is enclosed by a cover layer (12) that is made of fabric or paper material with natural fibers. The fabric or paper material is attached to and overlaid on an outer face of the main body (11) after being immerged into a resin. The cover layer (12) is enclosed by an outer layer (13). In the embodiment, the outer layer (13) is made of fabric material.

The cover layer (12) encloses the main body (11) to fill up the irregular of the outer face of the main body (11). Accordingly, the outer layer (13) encloses the cover layer (12) to achieve a smooth touch of the present invention. The cover layer (12) is provided as a lining of the outer layer (13), whereby the colors of the fabric-made outer layer is highlighted. Consequently, the outer periphery of the outer layer (13) is smooth and has highlight colors so that the toilet bowl cover (1) can provide a tender and warm feeling during using the present invention. Furthermore, the fabric-made outer layer (13) can provide a vivid vision and prolong the using life of the toilet bowl cover (1).

The outer layer (13) of the present invention can be made of paper material to reduce manufacturing cost of the toilet bowl cover. The outer layer (13) can be facially painted to substitute the conventional processing measures including buffing, filling and painting substrate paint, etc. for saving manufacturing time and labor.

Figure 4:
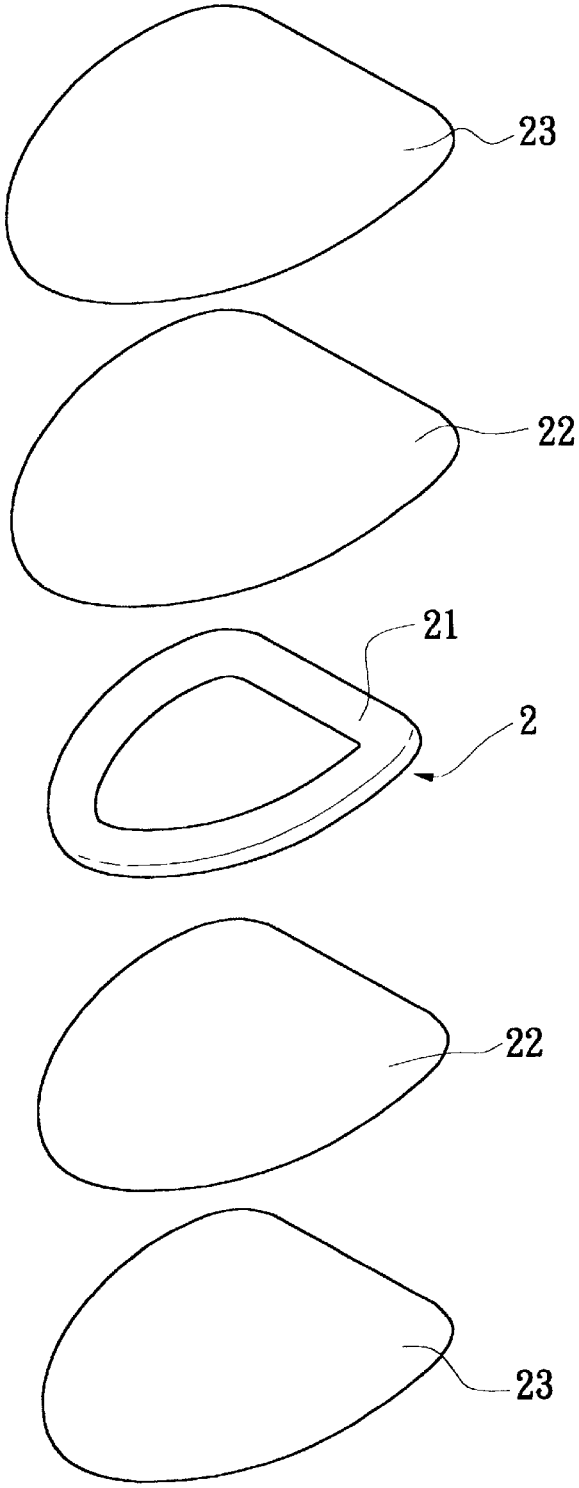
FIG. 4 is an exploded perspective view of a toilet bowl seat of the present invention.
Figure 5:
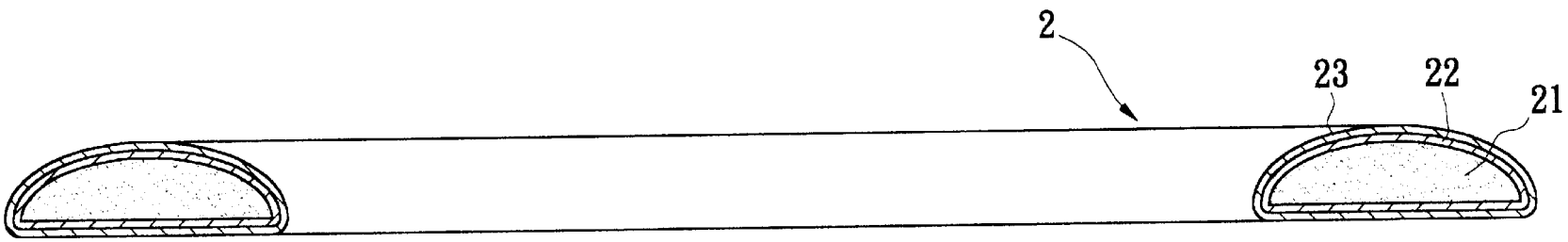
FIG. 5 is a sectional plan view of the toilet bowl seat of the present invention.

With reference to FIGS. 4 and 5, the toilet bowl seat (2) can be made of the above structure. The main body (21) of the toilet bowl seat (2) is enclosed by a cover layer (22). The cover layer (22) is further enclosed by an outer layer (23). Accordingly, the toilet bowl seat (2) can achieve the same effect as the toilet bowl cover (1).

Although the invention has been explained in relation to its preferred embodiment, it is to be understood that many other possible modifications and variations can be made without departing from the spirit and scope of the invention as hereinafter claimed.

What is claimed is:

1. A toilet bowl apparatus comprising a cover including a main body made of wooden material, the main body being enclosed by a cover layer, the cover layer being made of a material containing natural fibers, the cover layer being further enclosed by a reinforcing outer layer made of a paper material.

2. The toilet bowl apparatus as claimed in claim 1, wherein the cover layer is made of fabric material.

3. The toilet bowl apparatus as claimed in claim 1, wherein the cover layer is made of paper material with natural fibers.

4. The toilet bowl apparatus as claimed in claim 1, wherein the cover layer contains natural fibers combined with a resin material.

5. A toilet bowl apparatus comprising:

a seat and a cover coupled thereto, at least one of the seat and cover including a main body formed of wooden material, the main body being enveloped in conformed manner by a cover layer, the cover layer being overlaid by a laminating outer layer, the cover and outer layers being formed respectively of materials containing natural fibers, the natural fibers of at least the cover layer being combined with a resin material.

6. The toilet bowl apparatus as recited in claim 5, wherein each of the seat and cover including said main body, cover layer, and outer layer.

7. The toilet bowl apparatus as claimed in claim 5, wherein the cover layer is made of fabric material.

8. The toilet bowl apparatus as claimed in claim 5, wherein the cover layer is made of paper material with natural fibers.

* * * * *